US008650665B2

(12) United States Patent
Shirai

(10) Patent No.: US 8,650,665 B2
(45) **Date of Patent: *Feb. 18, 2014**

(54) BOTTOM PERIPHERY LENGTH ADJUSTMENT MECHANISM

(75) Inventor: Syoji Shirai, Tokyo (JP)

(73) Assignee: Builmatel Co., Ltd., Tokyo (JP)

( * ) Notice: Subject to any disclaimer, the term of this patent is extended or adjusted under 35 U.S.C. 154(b) by 0 days.

This patent is subject to a terminal disclaimer.

(21) Appl. No.: 13/482,351

(22) Filed: May 29, 2012

(65) Prior Publication Data

US 2012/0297521 A1 Nov. 29, 2012

Related U.S. Application Data

(63) Continuation of application No. PCT/JP2010/071023, filed on Nov. 25, 2010.

(30) Foreign Application Priority Data

Nov. 30, 2009 (JP) ..... 2009-272913
Feb. 5, 2010 (JP) ..... 2010-023765

(51) Int. Cl.
*A42B 1/22* (2006.01)

(52) U.S. Cl.
USPC ..... 2/183

(58) Field of Classification Search
USPC ..... 2/170, 171, 183, 417, 418, 419, 420, 2/421, DIG. 11; 24/68 BT, 274 WB, 68 B, 24/163 R, 168, 171, 178, 181, 191, 194, 24/590.1, 591.1, 68 E
See application file for complete search history.

(56) References Cited

U.S. PATENT DOCUMENTS

| | | | | |
|---|---|---|---|---|
| 4,999,846 | A | 3/1991 | Ball et al. | |
| 5,774,953 | A | 7/1998 | Mao | |
| 6,314,587 | B1 * | 11/2001 | Fang | 2/418 |
| 6,457,210 | B1 | 10/2002 | Shirai et al. | |
| 7,246,383 | B2 * | 7/2007 | Musal | 2/418 |
| 7,861,322 | B2 * | 1/2011 | Cho | 2/183 |
| 8,146,211 | B2 * | 4/2012 | Shirai et al. | 24/16 PB |
| 2010/0175232 | A1 | 7/2010 | Shirai et al. | |

FOREIGN PATENT DOCUMENTS

| | | |
|---|---|---|
| JP | 1983-168536 U | 11/1983 |
| JP | S58-168536 | 11/1983 |
| JP | 3005659 | 10/1994 |
| JP | 3005659 U | 1/1995 |
| JP | 4005109 | 8/2007 |
| WO | WO 2009/089625 | 7/2009 |
| WO | WO 2009/089625 A1 | 7/2009 |

* cited by examiner

*Primary Examiner* — Tejash Patel
(74) *Attorney, Agent, or Firm* — Manabu Kanesaka

(57) ABSTRACT

There is provided a bottom periphery length adjustment mechanism usable for apparel in which a very high importance is attached to design of appearance. The length adjustment mechanism comprises a slide adjuster. The slide adjuster comprises a band and a buckle that are formed of a synthetic resin. An engagement claw of the buckle is engaged with a serrated engagement groove provided on the outer surface of the band so that, in an engaged state, the band freely approaches the buckle but cannot retract. The buckle is fixed to the backside of the bottom. When the band approaches the buckle, the periphery of the bottom shrinks while, when the band moves away from the buckle, the periphery of the bottom expands.

21 Claims, 8 Drawing Sheets

BOTTOM PERIPHERY LENGTH ADJUSTMENT MECHANISM

RELATED APPLICATIONS

The present application is a continuation application of International Application No. PCT/JP2010/071023 filed on Nov. 25, 2010, and claims priority from, Japanese Application No. 2009-272913 filed on Nov. 30, 2009 and Japanese Application No. 2010-023765 filed on February 5.

TECHNICAL FIELD

This invention relates to a bottom periphery length adjustment mechanism comprising a slide adjuster and more particularly relates to a size adjustment mechanism for headwears or sun visors.

BACKGROUND ART

Conventional size adjustment mechanisms for headwears or sun visors include size adjustment mechanisms that use a belt and comprise an adjuster and a rail, American hook-type size adjustment mechanisms, and hook-and-loop fastener-type size adjustment mechanisms.

In the size adjustment mechanisms utilizing an adjuster and a rail, the adjuster is slid on the rail to adjust the size. These mechanisms are seldom used at the present time. In the American hook-type size adjustment mechanisms, a belt having about 7 holes formed therein is used in combination with a hooked belt to allows the size to be adjusted by shifting a position for fitting into the hole.

The use of hook-and-loop fasteners can allow belts to be prepared using the same cloth as used in the front cloth and thus can prevent loss of the texture of a cap body. The hook-and-loop fasteners, however, are generally weak against rain water and moisture. Further, dust or the like is likely to adhere thereon, sometimes leading to lowered bonding strength.

On the other hand, a method for size adjustment has also been proposed that does not use any belt and adopts a rubber as a material for a sweatband or a part of the sweatband in a cap. When the whole sweatband is elastic, there is a possibility that functions as the sweatband such as sweat absorption, quick drying, and deodorization are deteriorated. When rubber is used in a part of the sweatband, it is necessary to provide tucking to the cap body or to use a stretchable cloth. Further, the bonding strength of the rubber undergoes a significant aged deterioration and thus is likely to be significantly lowered.

Patent document 1 (Japanese Utility Model Application Laid-Open No. 168536/1983) discloses a free-size cap in which a band piece and a band piece-locking tool are interposed between a cap body and a sliding material provided on the inner side of the cap body to improve an appearance of the cap and a flexible foam sheet is internally provided as a core material in the sliding material to improve cap wearing comfort. In patent document 1, however, any consideration is not taken for attachment of the locking tool to the cap body, posing a problem that a stopper for release of locking is hit against the cloth constituting the cap body, resulting in unintentional release of locking.

On the other hand, patent document 2 (Japanese Utility Model Registration No. 3005659) discloses a size adjustment mechanism that can realize size adjustment in a cap worn state and, at the same time, can realize fine adjustment. The size adjustment mechanism disclosed in patent document 2 is likely to require an increased device size, and, thus, a restriction on design is increased for the attachment of the device to the cap. Thus, the size adjustment mechanism is impractical. Further, there is a possibility that, when the cap falls, the device is broken. Difficulties are encountered in attaching this device to sun visors, of which the area where the device can be attached is small.

The present inventor has previously proposed a slide adjuster usable for apparel such as headwears, trousers, or skirts in which a great importance is attached to design of appearance. The slide adjuster comprises a band and a buckle, an engagement claw in the buckle being engaged with a serrated engagement groove provided on an outer surface of the band so that, in an engaged state, the band freely approaches the buckle but cannot retract, wherein the buckle comprises: a buckle body comprising a bottom plate and a ceiling frame facing each other and two side plates for connecting the bottom plate to the ceiling frame, the inside of the buckle body functioning as a band insertion space; and an operating plate that is horizontally provided on the inner side of the ceiling frame, has, on an under surface at one end thereof, the engagement claw engageable with the engagement groove in the band, the other end functioning as a pressing part for the release of the engagement, and wherein the operating plate is supported by a connecting shaft between the two side plates at an intermediate point between the engagement claw and the pressing part to allow the operating plate to be swingable at the intermediate point as a fulcrum, and a pair of latch protrusions is provided on the outer surface of the band and the pressing part to allow the buckle and the band to be pulled by a fingertip in one hand (Japanese Patent No. 4005109: patent document 3).

PRIOR ART DOCUMENTS

Patent Documents

Patent document 1: Japanese Utility Model Application Laid-Open No. 168536/1983

Patent document 2: Japanese Utility Model Registration No. 3005659

Patent document 3: Japanese Patent No. 4005109

SUMMARY OF THE INVENTION

Problems to be Solved by the Invention

When the slide adjuster described in Japanese Patent No. 4005109 is used, a most part of the slide adjuster is hidden on the inner side of headwears, trousers, skirts or the like, but a part of the members is exposed to the appearance of the apparel.

Accordingly, from the viewpoint of enhancing the degree of freedom in design, a size adjustment mechanism has been demanded in which a size adjustment mechanism such as a slide adjuster is not exposed to the appearance of apparel such as headwears and sun visors and, at the same time, has excellent operability.

Thus, an object of the present invention is to provide a size adjustment mechanism usable for apparel in which a great importance is attached to design of appearance.

Means for Solving the Problems

According to the present invention, there is provided a bottom periphery length adjustment mechanism comprising a slide adjuster, wherein the slide adjuster comprises a band and a buckle that are formed of a synthetic resin and an engagement claw of the buckle is engaged with a serrated engagement groove provided on an outer surface of the band so that, in an engaged state, the band freely approaches the buckle but cannot retract, the buckle comprises: a buckle body that comprises a bottom plate and a ceiling frame facing each other and two side plates for connecting the bottom plate to the ceiling frame, the inside of the buckle serving as a band insertion space; and an operating plate that is horizontally provided on the inner side of the ceiling frame and has, on an under surface at one end, the engagement claw engageable with the engagement groove of the band, the other end functioning as a pressing part for releasing the engagement, the operating plate being supported by a connecting shaft between the two side plates or the ceiling frames at an intermediate point between the engagement claw and the pressing part to render the operating plate swingable around the intermediate point as a fulcrum, the buckle is fixed to the backside of the bottom, and when the band approaches the buckle, the periphery of the bottom shrinks while, when the band moves away from the buckle, the periphery of the bottom expands.

Preferably, the buckle is fixed to the backside of the bottom through the ceiling frame.

Preferably, the ceiling frame in its portion fixed to the backside of the bottom is formed of a flat plate.

Preferably, the ceiling frame that faces one end of the operating plate extends horizontally in a direction opposite to the operating plate.

Preferably, the bottom periphery is a lower rim (a lowermost part of crown) of a headwear or a sun visor and the buckle is fixed to the inner side of the lower rim or a sweatband.

Preferably, the buckle is fixed to the inner side of the lower rim through the ceiling frame.

Preferably, the ceiling frame in its portion fixed to the inner side of the lower rim is formed of a flat plate.

Preferably, the ceiling frame that faces one end of the operating plate extends horizontally in a direction opposite to the operating plate.

Preferably, the length adjustment mechanism comprises a visualizing unit provided in the sweatband in its portion where the band or the buckle is located on the inner side thereof.

Preferably, the band is exposed to the inner side of the lower rim which is a surface that comes into contact with a head.

Preferably, the band has a length equal to the inner circumference of the lower rim.

Preferably, a mark is put on a cloth constituting a body of the headwear in its portion corresponding to the pressing part.

Preferably, an opening is provided in a cloth constituting a body of the headwear in its portion corresponding to the pressing part.

Preferably, a sheath into which the front end of the band can enter is provided between the sweatband and the lower rim.

Preferably, a friction reducing sheet is provided on the sweatband and/or lower rim in their position where the front end of the band enters.

According to another aspect of the present invention, there is provided a headwear size adjustment mechanism comprising: a headwear size adjustment belt that has one end fixed to the rear of a body of the headwear and is horizontally provided; and a slide adjuster that is connected to the other end of the belt and is fixed to a side part of the body of the headwear, wherein the slide adjuster comprises a band and a buckle that are formed of a synthetic resin and an engagement claw of the buckle is engaged with a serrated engagement groove provided on an outer surface of the band so that, in an engaged state, the band freely approaches the buckle but cannot retract, the buckle comprises: a buckle body that comprises a bottom plate and a ceiling frame facing each other and two side plates for connecting the bottom plate to the ceiling frame, the inside of the buckle serving as a band insertion space; and an operating plate that is horizontally provided on the inner side of the ceiling frame and has, on an under surface at one end, the engagement claw engageable with the engagement groove of the band, the other end functioning as a pressing part for releasing the engagement, the operating plate being supported by a connecting shaft between the two side plates or the ceiling frames at an intermediate point between the engagement claw and the pressing part to render the operating plate swingable around the intermediate point as a fulcrum, and the band is connected to the other end of the belt and the buckle is fixed between the sweatband and the lower rim.

Preferably, in the headwear size adjustment mechanism, the buckle is fixed to the inner side of the lower rim through the ceiling frame.

Preferably, the ceiling frame in its portion fixed to the inner side of the lower rim is formed of a flat plate.

Preferably, the ceiling frame that faces one end of the operating plate extends horizontally in a direction opposite to the operating plate.

Preferably, in the headwear size adjustment mechanism, the belt is formed of a common cloth from the body of the headwear.

Preferably, a mark is put on a cloth constituting a body of the headwear in its portion corresponding to the pressing part.

Preferably, an opening is provided in a cloth constituting a body of the headwear in its portion corresponding to the pressing part.

Preferably, a sheath into which the front end of the band can enter is provided between the sweatband and the lower rim.

Preferably, a friction reducing sheet is provided on the sweatband and/or lower rim in their position where the front end of the band enters.

Further, according to the present invention, in a sun visor comprising a visor and a belt that is fixed to the visor and is horizontally provided, a size adjustment mechanism for a sun visor that has the same function as the size adjustment mechanism for the headwear can be realized by interposing the slide adjuster in a part of the belt.

Thus, according to a further aspect of the present invention, there is provided a size adjustment mechanism for a sun visor, the size adjustment mechanism for a sun visor comprising: a sun visor belt that is fixed to the visor and is horizontally provided; and a slide adjuster interposed in a part of the belt, wherein the slide adjuster comprises a band and a buckle that are formed of a synthetic resin and an engagement claw of the buckle is engaged with a serrated engagement groove provided on an outer surface of the band so that, in an engaged state, the band freely approaches the buckle but cannot retract, the buckle comprises: a buckle body that comprises a bottom plate and a ceiling frame facing each other and two side plates for connecting the bottom plate to the ceiling frame, the inside of the buckle serving as a band insertion space; and an operating plate that is horizontally provided on the inner side of the ceiling frame and has, on an under surface at one end, an engagement claw engageable with the engagement groove of the band, the other end functioning as a pressing part for releasing the engagement, the operating plate being supported by a connecting shaft between the two side plates or the ceiling frames at an intermediate point between the engagement claw and the pressing part to render the operating plate swingable around the intermediate point as a fulcrum, and the band is connected to one end of the belt and the buckle is fixed between the sweatband and the belt.

Effect of the Invention

In the bottom periphery length adjustment mechanism comprising a slide adjuster according to the present invention, the size adjustment mechanism such as the slide adjuster is not exposed to the appearance at all and thus is advantageous in that the degree of freedom in design of apparel such as headwears is significantly increased and, at the same time, a sense of luxury can be provided.

Since the slide adjuster has a lightweight and simple construction, the size adjustment can be performed quickly and easily.

According to the size adjustment mechanism according to the present invention in which the buckle is fixed to the inner side of the headwear through the ceiling frame, the slide adjuster can easily be attached to the inner side of apparel such as headwears, and, thus apparel such as headwears can be mass-produced without much labor hour and cost.

DESCRIPTION OF REFERENCE CHARACTERS

Figure 1:
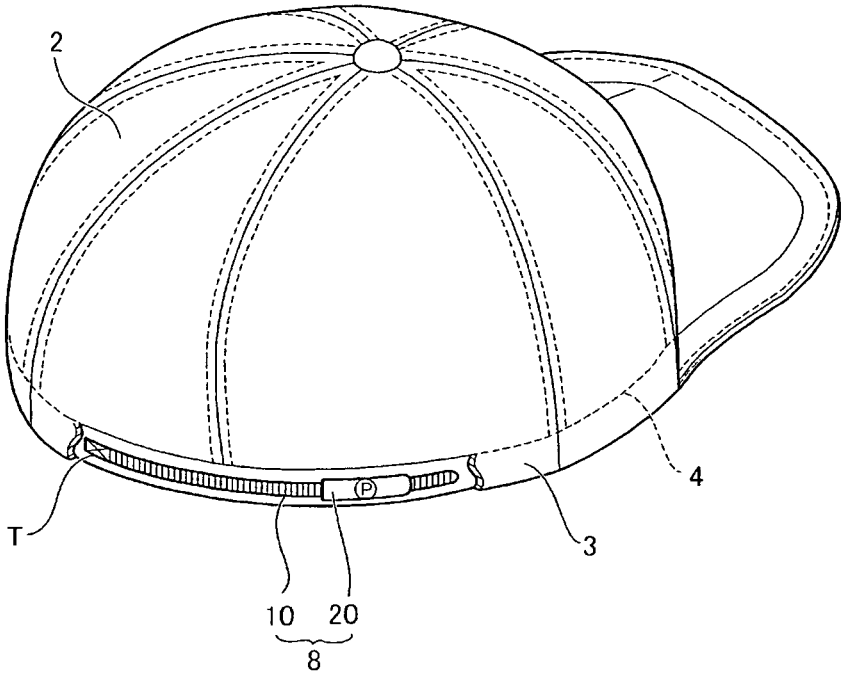
FIG. 1 is a perspective view of a cap as viewed from above a right rear thereof, wherein a bottom periphery length adjustment mechanism, which is a principal part of the present invention, is perspectively depicted.

2 Cap
3 Lower rim
4 Sweatband
5 Through-holes as visualizing unit
8 Slide adjuster
10 Band
12 Engagement groove
20 Buckle
22 Ceiling frame
22*a* Extended ceiling frame
24 Buckle body
30 Operating plate
31 Engagement claw
32 Pressing part
40 Opening
41 Mark
B Belt

MODE FOR CARRYING OUT THE INVENTION

Embodiments of headwears having a bottom periphery length adjustment mechanism according to the present invention will be described in conjunction with the accompanying drawings. However, it should be noted that, also for sun visors having the same adjustment mechanism, contemplated object and effect will be attained by the same construction.

FIG. 1 is a perspective view of a cap as viewed from above a right rear thereof, wherein a bottom periphery length adjustment mechanism, which is a principal part of the present invention, is perspectively depicted. The cap comprises a cap body 2, a lower rim (also known as "lowermost part of crown" and "circumference") 3, and a sweatband (also referred to as size belt) 4.

A slide adjuster 8 provided within the cap comprises a band 10 and a buckle 20 that will be described later in conjunction with FIG. 2. The buckle 20 is fixed between the sweatband 4 and the cap body 2. More specifically, the buckle 20 is fixed to any of a cloth of the sweatband 4 or a cloth of the cap body 2. The band 10 may be fixed to a cloth of the sweatband 4 or a cloth of the cap body 2 at an attachment part T, excluding the case where, as described later, the length of the band 10 is equal to the length of the inner circumference of the lower rim 3. The band 10 and the buckle 20 may be provided at any position in a circumferential direction of the lower rim 3, and, thus, a pressing part 32 for engagement release which will be described later may also be provided at any position of the lower rim 3.

Next, the slide adjuster will be described in conjunction with FIG. 2.

Figure 2:
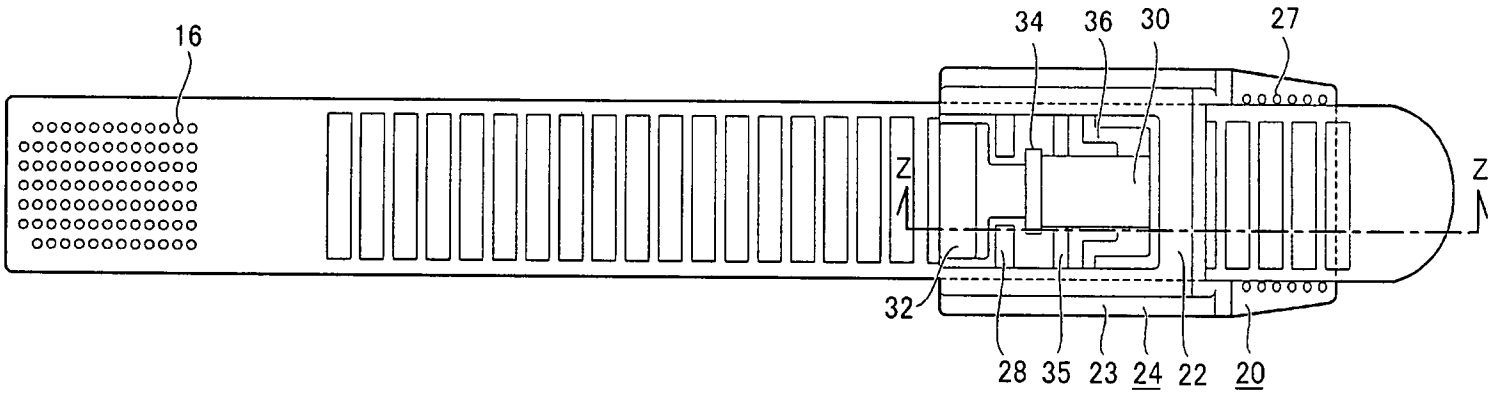
FIG. 2 is a diagram showing a slide adjuster 8, wherein FIG. 2 (1) is a plain view and FIG. 2 (2), (3) are longitudinal sectional side views taken on a cutout line z-z of FIG. 2 (1).
Figure 2:
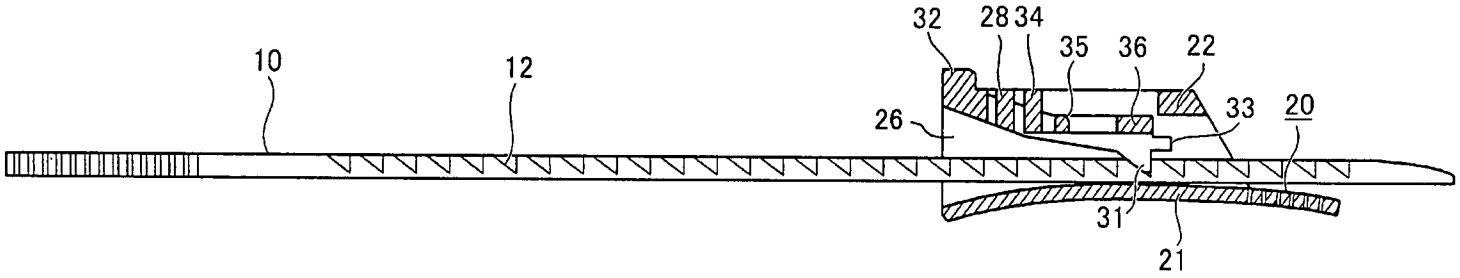
Figure 2:
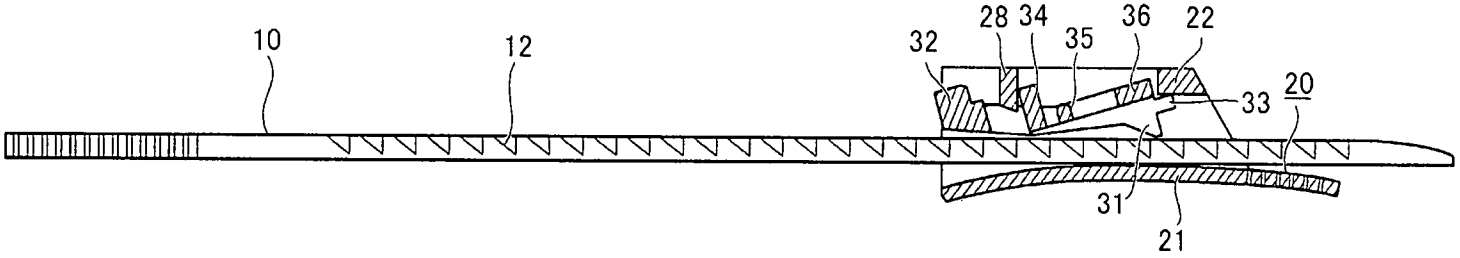

FIG. 2 shows a slide adjuster comprising a band 10 and a buckle 20, wherein FIG. 2 (1) is a plain view and FIG. 2 (2) is a longitudinal sectional side view taken on a cutout line z-z of FIG. 2 (1).

In these drawings, a serrated engagement groove 12 is provided on an outer surface of a band 10 having required length, width, and thickness, from the front end (a portion close to the buckle 20) to the rear end. A number of attachment holes 16 are provided at the rear end of the band 10 for fixing the band 10 to the lower rim 3 or the sweatband 4 of the cap.

The buckle 20 is composed mainly of a flat and cylindrical buckle body 24. The buckle body 24 comprises a bottom plate 21, a ceiling frame 22 opposed to the bottom plate 21, and side plates 23, 23 that connect the bottom plate 21 to the ceiling frame 22. In the buckle body 24, a slide direction of the band 10 is opened as an insertion port, and the inside of the buckle body 24 functions as an insertion space 26 for the band 10. In this embodiment, when the length in the longitudinal direction (a slide direction of the band 10) of the bottom plate 21 is larger than the length in the longitudinal direction of the ceiling frame 22, attachment to the lower rim 3 or the sweatband 4 is facilitated by attachment holes 27 provided in the bottom plate 21 and, at the same time, the band 10 can easily be inserted into the insertion space.

An operating plate 30 is horizontally provided at the inner side of the ceiling frame 22. The operating plate 30 has a size that is received therein. An engagement claw 31 engageable with the engagement groove 12 of the band 10 is provided in a projected form on an under surface at one end of the operating plate 30. An upper surface of the other end of the operating plate 30 functions as a pressing part 32 for engagement release. In this embodiment, the pressing part 32 has a height that goes through the ceiling frame 22. The height, however, is not particularly limited. When the height of the pressing part 32 is equal to or lower than that of the ceiling frame 22, accidental engagement release as a result of hitting of a part of apparel or the like against the pressing part 32 can be prevented even though the buckle 20 is fixed to the inner side of the apparel or the like.

A connecting shaft 35 is provided at an intermediate point in the longitudinal direction of the operating plate 30 and is connected to the inner wall at the upper part of the two side plates 23, 23. The sectional form of the connecting shaft 35 include circular, elliptical, or other various shapes. Any shape may be adopted in the connecting shaft 35 as long as the connecting shaft 35 can pivotably support the operating plate 30 in a swingable form and, at the same time, is not broken by repetitive swinging of the operating plate 30. The connecting shaft 35 may be supported by the two side plates 23, 23. Alternatively, the connecting shaft 35 may be supported by two sides of the ceiling frame 22 located opposite to the operating plate 30, and, also in this case, the connecting shaft 35 can exert the same function as the function which will be described later.

In the operating plate 30 according to the present invention, the lateral width between the pressing part 32 and the connecting shaft 35 is set to as small as possible, so long as swinging and strength requirements of the operating plate 30 are met. Further, in the buckle body 24, overhangs 28, 28 are extended as a restriction member from the opposed ceiling frames 22, 22 horizontally in an inward direction. The restriction member is a member that restricts unintentional application of a vertical force to the pressing part 32.

In the embodiment shown in FIG. 2, one end of the operating plate 30 (a side on which the engagement claw 31 is provided) is connected to the inner wall of the two opposed side plates 23, 23 by bent connecting members 36, 36 that are extended from the corner of the operating plate 30. According to this embodiment, when the pressing part 32 is depressed followed by detachment of the finger from the pressing part 32, the pressing plate 30 can easily be restored in an original horizontal state. Accordingly, in addition to the above shape, various other shapes such as corrugated plates can be applied to the connecting member 36. In other words, the connecting member 36 functions as a damper against the swinging action of the operating plate 30.

Connection between the operating plate 30 and the side plate 23 on the opposite side of the pressing part 32 with the connecting shaft 35 located therebetween suffices for contemplated results. The side plate 23 may be connected to a side edge of the operating plate 30, that is, a portion other than the one end of the operating plate 30. The operating plate 30 may be connected to the ceiling frame 22 instead of the side plate 23.

A protrusion 33 provided at one end of the operating plate 30 (a side on which the engagement claw 31 is provided) functions as a stopper that prevents the pressing part 32 of the operating plate 30 from being depressed in engagement release to a level more than necessary.

Numeral 34 also designates a stopper that, upon the depression of the pressing part 32, is abutted against the side surface of the overhang 28 (see FIG. 2 (3)) to prevent the pressing part 32 from being depressed to a level more than necessary leading to an unfavorable phenomenon that the operating plate 30 hit against the upper surface of the band 10. The provision of one of these stoppers 33, 34 suffices for contemplated results.

The band 10 and the buckle 20 may be formed by molding with a flexible synthetic resin. When the band 10 is formed of a synthetic resin, the band 10 can be smoothly inserted into between the sweatband 4 and the lower rim 3. That is, the synthetic resin has higher rigidity than a cloth or a woven fabric constituting the sweatband 4 and the lower rim 3 and, thus, the band 10 can easily be inserted thereinto.

The buckle 20 is preferably formed by molding with elastic synthetic resins such as polyacetal, polyoxymethylene, polyamide, and polycarbonate resins because of the necessity of swinging the operating plate 30 around the connecting shaft 35. The buckle 20 is constructed using a small number of components and has a simple structure and, thus, can easily be formed by integral molding in a mold.

Subsequently, the function of the size adjustment mechanism shown in FIG. 1 will be described.

In adjusting the cap size, a method may be adopted that, in such a state that the cap is not worn, the cap in its position corresponding to the band 10 in the lower rim 3 (or the sweatband 4) is held by a fingertip in one hand and the lower rim 3 (or the sweatband 4) provided in its interior with the slide adjuster 8 is held by a fingertip in the other hand, and, thereafter, both the hands are put close to each other.

Figure 3:
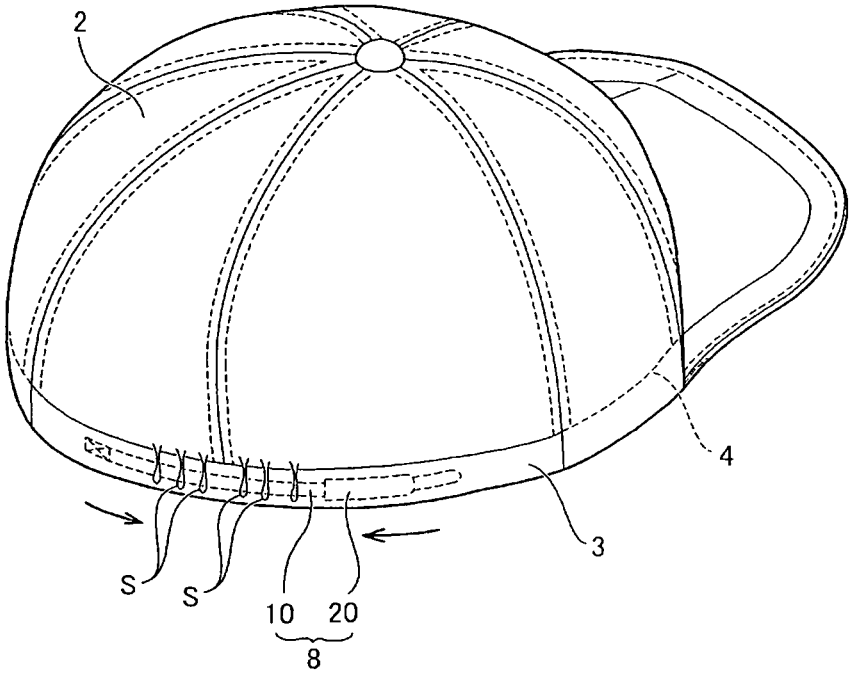
FIG. 3 is a perspective view of a cap having a bottom periphery length adjustment mechanism according to the present invention, as viewed from above a right rear thereof.

FIG. 3 is a perspective view of a cap in such a state that the bottom periphery has shrunk. The drawing indicates that wrinkles S are formed in the lower rim 3 and the cap body 2 at their portions around the slide adjuster 8.

This operation allows the cap to be adjusted to a smaller size. In this case, even when the distance between both the hands is increased, the size of the cap is not increased by the function of the slide adjuster 8. When the size of the cap is increased, that is, when the lower rim 3 is expanded, the lower rim 3 or the sweatband 4 in its portion corresponding to a portion, in the slide adjuster 8, where the pressing part 32 is hidden is pressed by a fingertip or the like.

Figure 4:
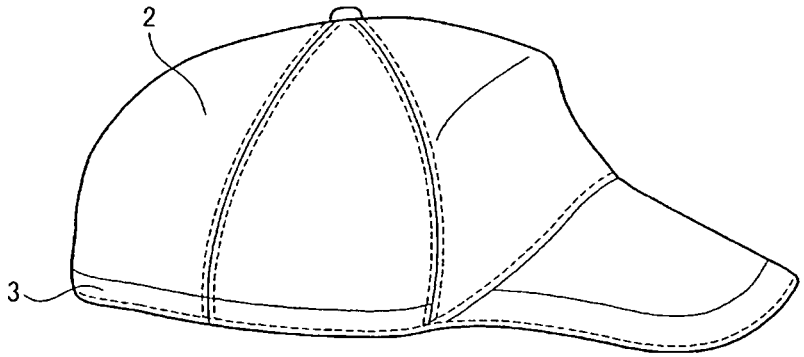
FIG. 4 is a right side view of a cap having a bottom periphery length adjustment mechanism according to the present invention.
Figure 4:
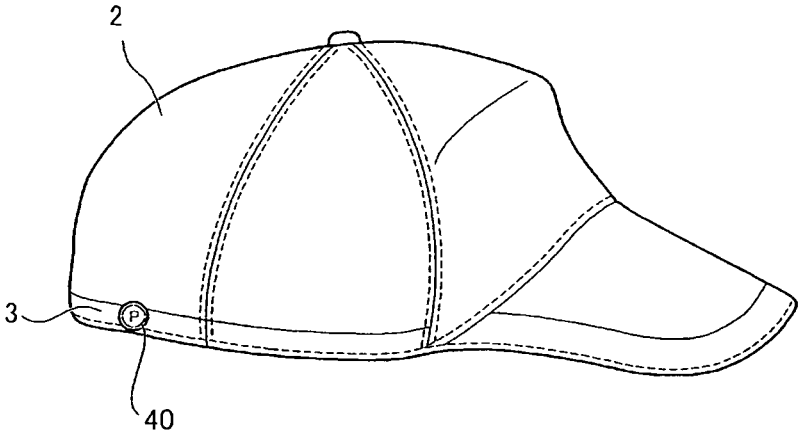
Figure 4:
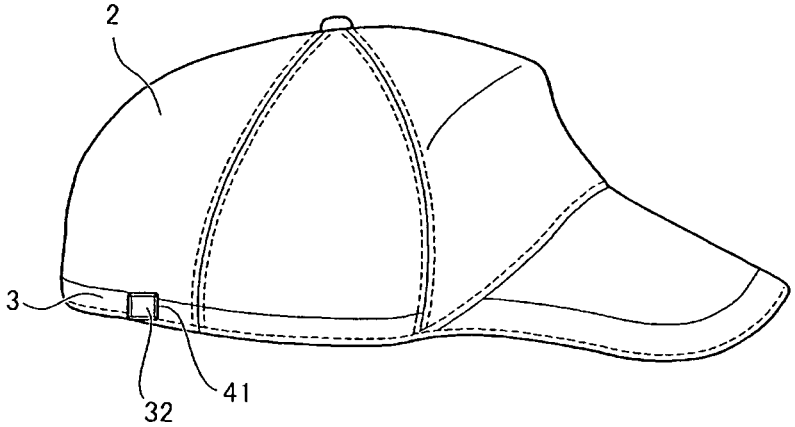

FIG. 4 is a right side view of a cap having a size adjustment mechanism according to the present invention.

In the embodiment shown in FIG. 4 (1), the slide adjuster 8 is completely hidden in the inner side of the cap body 2 and thus is not exposed to the appearance.

In the embodiment shown in FIG. 4 (2), a mark 40 is put on a cloth constituting the cap body 2 in its portion corresponding to the adjuster 8 in its portion where the pressing part 32 is hidden.

In the embodiment shown in FIG. 4 (3), an opening 41 is provided in a cloth constituting the cap body 2 in its portion corresponding to the slide adjuster 8 in its portion corresponding to the pressing part 32, and the pressing part 32 is exposed through the opening 41 to the appearance.

The function of the slide adjuster will be described. FIG. 2 (2) shows such a state that the band 10 is inserted into the insertion space 26 in the buckle 20, and the engagement claw 31 in the buckle 20 is engaged with the engagement groove 12 provided on an outer surface of the band 10. The engagement groove 12 comprises: a tapered surface, in which the sectional form in the slide direction is in a serrated form, that is, the depth is gradually increased in a direction of travel of the band 10; and a wall surface that stands substantially vertically from the deepest position.

When the band 10 is entered from the pressing part 32 side (left side in FIG. 2 (2)) into the insertion space 26 in the buckle body 24, the upper surface of the band 10 comes into contact with the engagement claw 31 in the operating plate 30 and advances while pushing up one end of the operating plate 30 (a side on which the engagement claw 31 is provided) to adjust a position of the band 10 relative to the buckle 20 (approach or moving-away). In this state, as shown in FIG. 2 (2), the engagement claw 31 is engaged with the predetermined engagement groove 12, and, thus, the band 10 can advance relative to the buckle 20 but cannot retract.

On the other hand, the band 10 can be retracted or pulled out from the buckle 20 as follows. When the pressing part 32 in the operating plate 20 is lightly pressed by a finger, as shown in FIG. 2 (3), the operating plate 30 is rotated about the connecting shaft 35. As a result, the engagement claw 31 located on the opposite side is lifted, the engagement claw 31 is disengaged from the engagement groove 12 and, thus, the band 10 can be freely slid. When the finger is disengaged from the pressing part 32, the pressing part 32 is restored to an original horizontal state by the elastic properties of the synthetic resin.

In the present invention, the structure of the slide adjuster 8 is not limited to the above structure, and any structure may be adopted as long as the slide adjuster comprising a buckle and a band is such that an engagement groove is provided in the band, a hook of the buckle is elastically engaged with the groove, and the engaged state can be released as needed by a push button that is actuated substantially vertically relative to the band.

In the embodiment shown in FIG. 2, the buckle body 24 comprises a bottom plate 21, a ceiling frame 22, and side plates 23, 23. All of four sides of the ceiling frame are not always required. Specifically, two sides parallel to the connecting shaft 35 can be omitted, or alternatively, the provision of any one of the four sides may be adopted.

In the embodiments described above, the ceiling frame 22 per se is not always required. When the buckle body 24 is free from the ceiling frame 22, the insertion space 26 for the band 10 is defined by the bottom plate 21, the side plates 23, 23, and the connecting shaft 35. The insertion space 26 can also be provided by the connecting members 36, 36.

An embodiment of the buckle 20 according to the present invention will be described in conjunction with FIG. 5 (perspective view).

In this embodiment, the ceiling frame 22 constituting the buckle body 24 is formed of a flat plate to allow the buckle 20 to be easily attached to the inner side of apparel such as a cap. This embodiment is advantageous in that apparel, for example, headwears such as caps can be mass-produced without much labor hour and cost.

Figure 5:
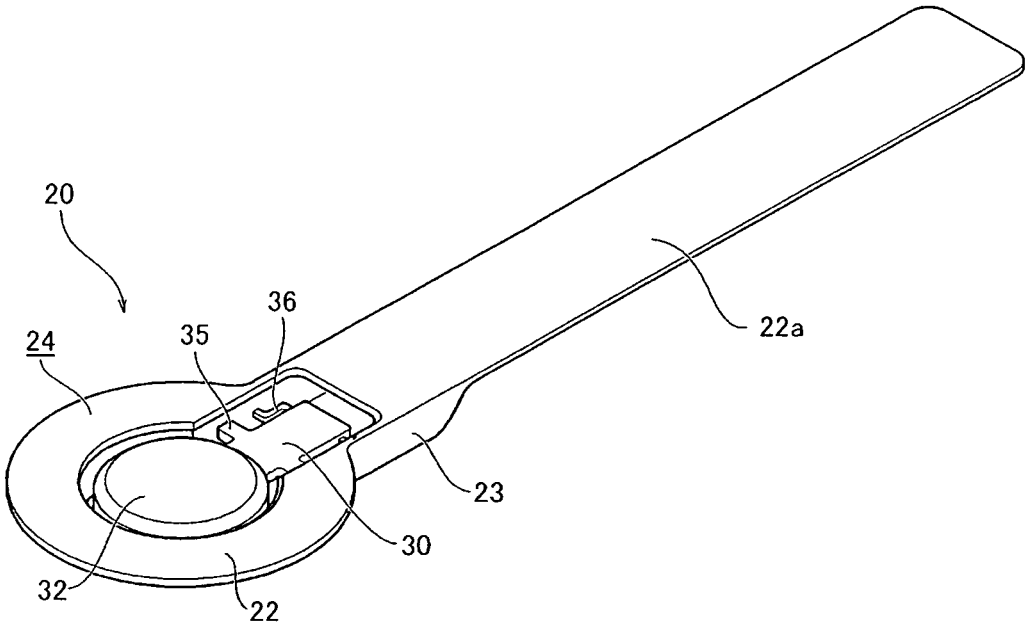
FIG. 5 is a diagram showing another embodiment of a buckle according to the present invention, wherein FIG. 5 (1) is a perspective view of the buckle as viewed from above and FIG. 5 (2) is a perspective view of the buckle as viewed from below.
Figure 5:
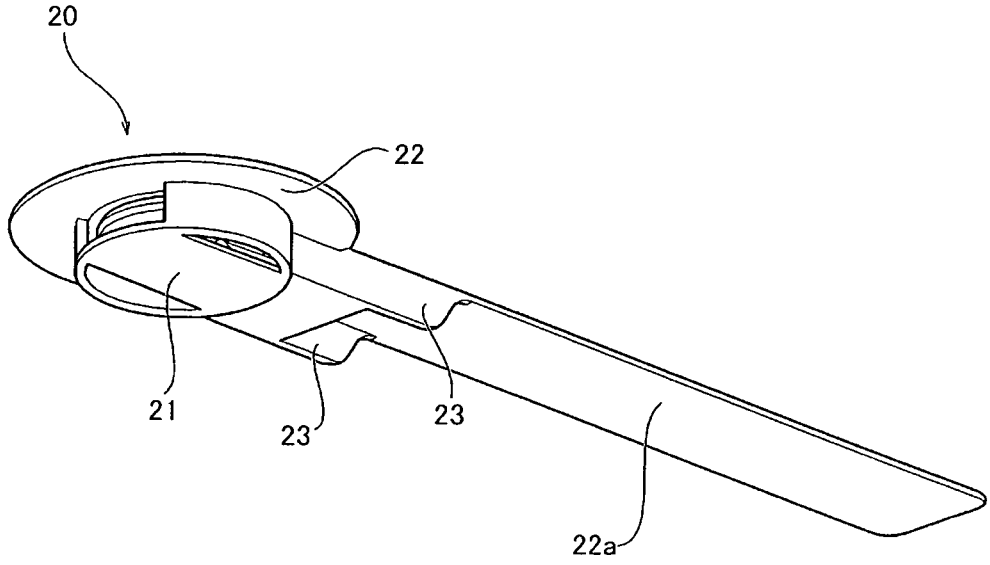

In FIG. 5, the pressing part 32 is formed in a small circular form that can easily be pressed by a fingertip in one hand. Alternatively, the pressing part 32 may be formed in a square form. The ceiling frame 22 surrounding the circular pressing part 32 is a donut-shaped flat plate and is fixed to the inner side of the lower rim 3 of the cap.

In general, preferably, the ceiling frame 22 is fixed by sewing. The fixation method, however, is not limited to the sewing, and fixation methods using caulking and pressure-sensitive adhesive double coated tapes may also be adopted.

In FIG. 5, numeral 22*a* designates a ceiling frame 22 that faces one end of the operating plate 30 and is extended horizontally in a direction opposite to the operating plate 30. The buckle 20 is reliably fixed to the lower rim 3 by a ceiling frame 22*a*, and, in sliding of the band 10, the front end of the band 10 is entered along a lower surface (a surface that faces the bottom plate 21) of the ceiling frame 22*a*, whereby the ceiling frame 22*a* functions also as a slide guide or a sheath which will be described later.

When the length of the ceiling frame 22*a* that is extended is approximately equal to that of the band 10, the ceiling frame 22*a* can satisfactorily function as the slide guide or the sheath.

On the other hand, when the fixation of the buckle to the lower rim 3 through the ceiling frame 22 is contemplated, the formation of any desired part of the ceiling frame 22 by a flat plate suffices for the contemplated results.

In the present invention, for unimpeded size adjustment purposes, a sheath (not shown) into which the front end of the band 10 can be entered may be provided between the sweatband 4 and the lower rim 3. Further, in the sweatband 4 and/or the lower rim 3, a friction reducing sheet (not shown) may be provided at a position where the front end of the band 10 is entered. The front end of the band 10 is entered while being guided or along the friction reducing sheet, and, consequently, the band 10 can be smoothly inserted.

In the embodiment shown in FIG. 1, a cap was described. The size adjustment mechanism of the cap according to the present invention is applicable to hunting caps and the like. In this case, as with the caps, tucks or wrinkles are provided in a cloth in a bottom (lower rim 3) or a sweatband 4 in a cap body 2 to which a slide adjuster 8 is attached.

An embodiment where the size adjustment mechanism according to the present invention is applied to a cap comprising a size adjustment belt B will be described with reference to FIG. 6.

Figure 6:
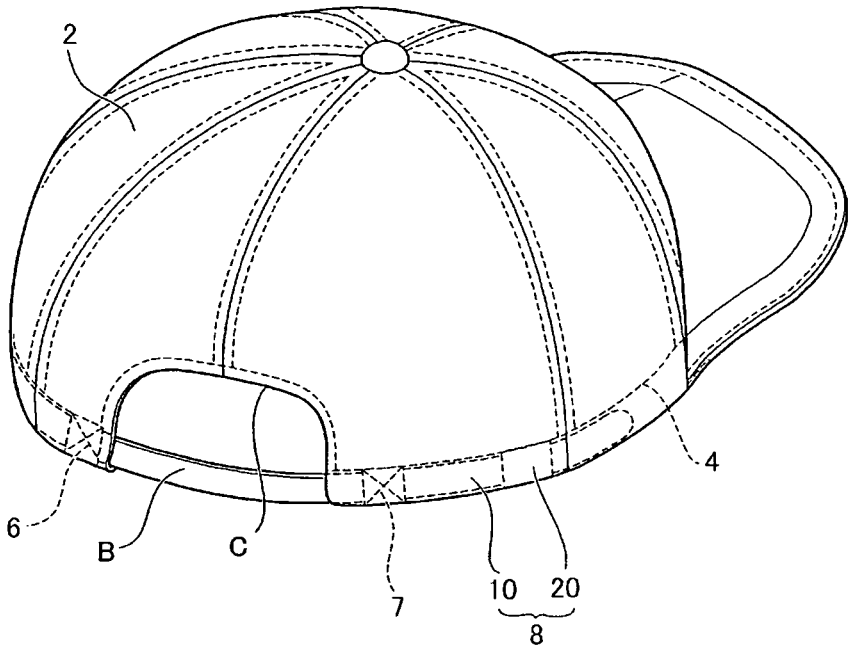
FIG. 6 is a perspective view of another cap comprising a size adjustment mechanism according to the present invention, as viewed from above a right rear thereof.

FIG. 6 is a perspective view of a cap comprising a size adjustment mechanism, as viewed from above a right rear thereof. The cap comprises a cap body 2, a size adjustment belt B, and a sweatband (also referred to as a size belt) 4.

The belt B is provided substantially horizontally at a lower end of a semi-circular cut C provided in a rear of the cap body 2, and one end 6 of the belt B (left end in FIG. 6) is fixed to the cap body 2. The other end 7 of the belt B (right end in FIG. 6) is connected to a slide adjuster 8 fixed to a side part of the cap body 2.

The structure and the function of the slide adjuster 8 are the same as those described above in connection with the embodiment shown in FIG. 1, and the description thereof will be omitted.

The function of the size adjustment mechanism shown in FIG. 6 will be described.

In adjusting the cap size, a method may be adopted that, in such a state that the cap is not worn, the belt B or the cap body 2 (or the sweatband 4) in its position corresponding to the other end 7 of the belt B or the band 10 is held by a fingertip in one hand and the cap body 2 (or sweatband 4) in its portion where the slide adjuster 8 is provided on the inner side thereof is held by a fingertip in the other hand, and, thereafter, both the hands are put close to each other.

This operation allows the cap to be adjusted to a smaller size. In this case, even when the distance between both the hands is increased, the size of the cap is not increased by the function of the slide adjuster 8. When the size of the cap is increased, that is, when the belt B is expanded, the cap body 2 or the sweatband 4 in its portion corresponding to a portion, in the slide adjuster 8, where the pressing part 32 is hidden is pressed by a fingertip or the like.

Figure 7:
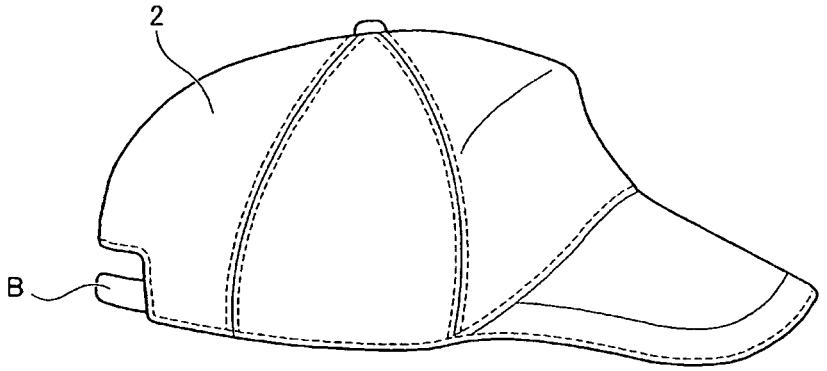
FIG. 7 is a right side view of the cap shown in FIG. 6.
Figure 7:
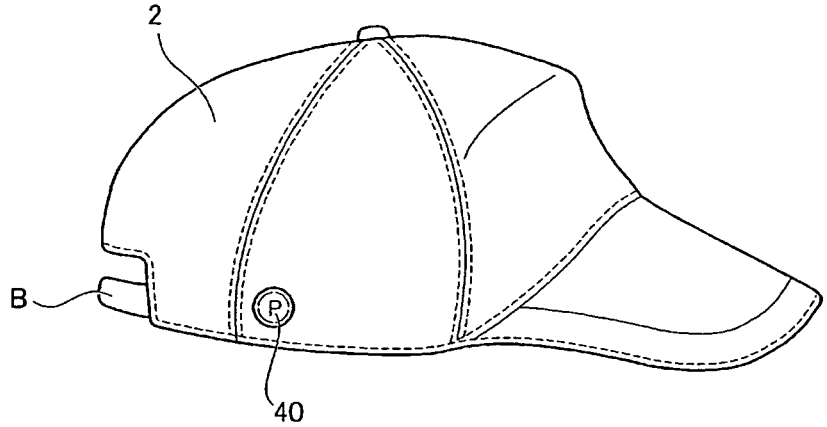
Figure 7:
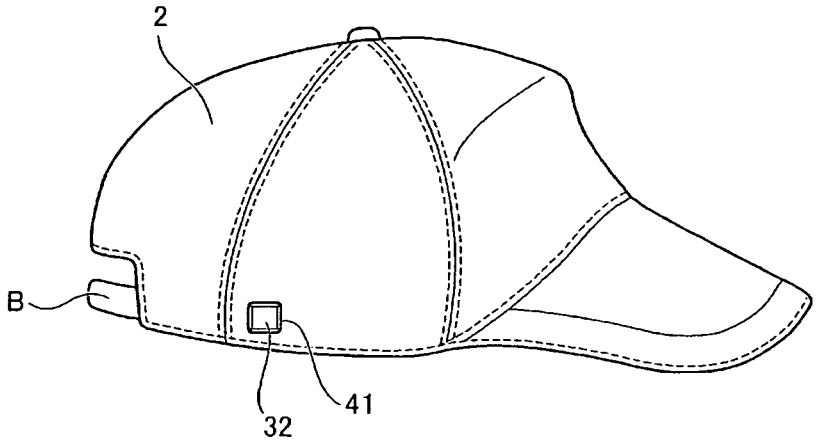

FIG. 7 is a right side view of a cap comprising a size adjustment mechanism according to the present invention.

In the embodiment shown in FIG. 7 (1), the slide adjuster 8 is hidden in the inner side of the cap body 2 and thus is not exposed to the appearance.

In the embodiment shown in FIG. 7 (2), a mark 40 is put on a cloth constituting the cap body 2 in its portion corresponding to the slide adjuster 8 in its portion where the pressing part 32 is hidden.

In the embodiment shown in FIG. 7 (3), an opening 41 is provided in a cloth constituting the cap body 2 in its portion corresponding to the slide adjuster 8 in its portion corresponding to the pressing part 32, and the pressing part 32 is exposed through the opening 41 to the appearance.

In the cap comprising the sweatband 4 according to the present invention, the length of the lower rim 3 can easily be adjusted by providing a visualizing unit for the band 10 or the buckle 20 in the sweatband 4 in its portion where the band 10 or the buckle 20 is located on the inner side thereof.

Figure 8:
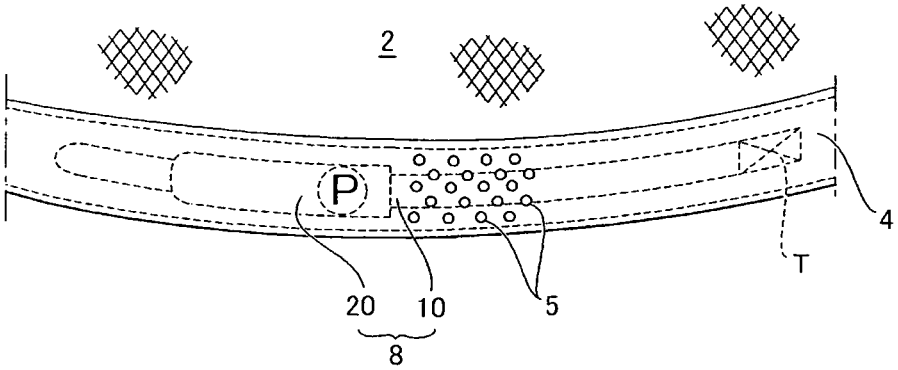
FIG. 8 is a partial plain view of a sweatband 4 comprising a visualizing unit.

FIG. 8 is a partial plain view of a sweatband 4 comprising a visualizing unit. In this embodiment, through-holes 5 are provided as the visualizing unit. As shown in FIG. 8, the provision of a plurality of through-holes 5, 5 . . . according to the width of the sweatband 4 can allow the position of the band 10 or the buckle 20 hidden on the inner side of the sweatband 4 to be visibly recognized. When the color of the sweatband 4 is different from that of the band 10 or the buckle 20, the band 10 or the buckle 20 can be visibly recognized more easily.

For the visualization unit, the through-holes 5, 5 . . . may be formed in an elongated slit form, or alternatively, a transparent or semi-transparent sweatband 4 may be adopted.

The sweatband 4 is not always required in the length adjustment mechanism for the circumference of the cap according to the present invention. When the sweatband 4 is not provided, the buckle 20 (or the band 10 and the buckle 20) is fixed to the lower rim 3. In this case, when the slide adjuster 8 is shrunk, in such a state that the cap is worn, the band 10 is in contact with the head, but the lower rim 3 is not in contact with the head. Accordingly, a space is formed between the head and the lower rim 3, and, thus, a person who wears the cap can easily enjoy a feeling of coolness. Further, since only a limited region comes into contact with the head hair, the disorder of the head hair in the cap-worn state can be significantly reduced.

The same effect can be attained by an embodiment where the sweatband 4 is not provided only at a position where the band 10 is located, or by an embodiment where, although the sweatband 4 is provided around the head, only the band 10 constituting the slide adjuster 8 is exposed on the surface of the sweatband 4 (a surface that comes into contact with the head). In this case, the size adjustment can easily be performed by, while directly holding the exposed band 10 by a fingertip in one hand, putting the band 10 close to the buckle 20.

In the above description, the band 10 has a length long enough to satisfactorily function as a length adjustment mechanism. In another embodiment of the present invention, the length of the band 10 is equal to the length of the inner circumference of the lower rim 3. According to this embodiment, in addition to the effect of providing the feeling of coolness and the effect of preventing the disorder of the head hair, an additional effect can be attained that can eliminate the need to provide wrinkles S or tucks to be provided in the cap.

INDUSTRIAL APPLICABILITY

Embodiments of the size adjustment mechanism in headwears have been described above. Also in sun visors, bottom and waist portions of trousers and waist portions of skirts, a size adjustment mechanism for apparel having the same function can be constructed by interposing the slide adjuster. Further, the present invention can be applied to a wide variety of headwears such as caps and hunting caps. Furthermore, the present invention can also be applied to an opening portion of eco bags.

The invention claimed is:

1. A bottom periphery length adjustment mechanism comprising:

a slide adjuster, wherein the slide adjuster comprises a band and a buckle that are formed of a synthetic resin and an engagement claw of the buckle is engaged with a serrated engagement groove provided on an outer surface of the band so that, in an engaged state, the band non-retractably approaches the buckle;

the buckle comprises a buckle body that comprises a bottom plate and a ceiling frame facing to each other and two side plates for connecting the bottom plate to the ceiling frame, an inside of the buckle serving as a band insertion space; and an operating plate that is horizontally provided on an inner side of the ceiling frame and has, on an under surface at one end, the engagement claw engageable with the engagement groove of the band, the other end functioning as a pressing part for releasing the engagement, the operating plate being supported by a connecting shaft between the two side plates or the ceiling frames at an intermediate point between the engagement claw and the pressing part to render the operating plate swingable around the intermediate point as a fulcrum;

a height of the pressing part is equal to or lower than that of the ceiling frame;

the buckle is fixed to a backside of the bottom through the ceiling frame; and when the band approaches the buckle, the periphery of the bottom shrinks, and when the band moves away from the buckle, the periphery of the bottom expands.

2. The bottom periphery length adjustment mechanism according to claim 1, wherein the ceiling frame in a portion fixed to the backside of the bottom is formed of a flat plate.

3. The bottom periphery length adjustment mechanism according to claim 2, wherein the ceiling frame facing one end of the operating plate extends horizontally in a direction opposite to the operating plate.

4. The bottom periphery length adjustment mechanism according to claim 1, wherein the bottom periphery is a lower rim of a headwear or a sun visor and the buckle is fixed to an inner side of the lower rim or a sweatband through the ceiling frame.

5. The bottom periphery length adjustment mechanism according to claim 4, wherein the ceiling frame in a portion fixed to the inner side of the lower rim or the sweatband is formed of a flat plate.

6. The bottom periphery length adjustment mechanism according to claim 5, wherein the ceiling frame facing one end of the operating plate extends horizontally in a direction opposite to the operating plate.

7. The bottom periphery length adjustment mechanism for according to claim 4, wherein a visualizing unit is provided in the sweatband in a portion where the band or the buckle is located on the inner side thereof.

8. The bottom periphery length adjustment mechanism according to claim 4, wherein the band is exposed to the inner side of the lower rim.

9. The bottom periphery length adjustment mechanism to claim 8, wherein the band has a length equal to an inner circumference of the lower rim.

10. The bottom periphery length adjustment mechanism according to claim 4, wherein a mark is put on a cloth constituting a body of the headwear in a portion corresponding to the pressing part.

11. The bottom periphery length adjustment mechanism according to claim 4, wherein an opening having a size to expose only appearance of the pressing part is provided in a cloth constituting a body of the headwear in a portion corresponding to the pressing part.

12. The bottom periphery length adjustment mechanism according to claim 4, wherein a sheath into which the front end of the band is capable of entering is provided between the sweatband and the lower rim.

13. The bottom periphery length adjustment mechanism according to claim 4, wherein a friction reducing sheet is provided on the sweatband and/or lower rim in a position where the front end of the band enters.

14. A headwear size adjustment mechanism comprising:

a headwear size adjustment belt that has one end fixed to a rear of a body of a headwear and is horizontally provided; and a slide adjuster that is connected to the other end of the belt and is fixed to a side part of the body of the headwear, wherein the slide adjuster comprises a band and a buckle that are formed of a synthetic resin and an engagement claw of the buckle is engaged with a serrated engagement groove provided on an outer surface of the band so that, in an engaged state, the band non-retractably approaches the buckle but cannot retract;

the buckle comprises a buckle body that comprises a bottom plate and a ceiling frame facing each other and two side plates for connecting the bottom plate to the ceiling frame, an inside of the buckle serving as a band insertion space; and an operating plate that is horizontally provided on an inner side of the ceiling frame and has, on an under surface at one end, the engagement claw engageable with the engagement groove of the band, the other end functioning as a pressing part for releasing the engagement, the operating plate being supported by a connecting shaft between the two side plates or the ceiling frames at an intermediate point between the engagement claw and the pressing part to render the operating plate swingable around the intermediate point as a fulcrum;

a height of the pressing part is equal to or lower than that of the ceiling frame; and the band is connected to the other end of the belt and the buckle is fixed to an inner side of a lower rim or a sweatband through the ceiling frame.

15. The headwear size adjustment mechanism according to claim 14, wherein the ceiling frame in a portion fixed to the inner side of the lower rim or the sweatband is formed of a flat plate.

16. The headwear size adjustment mechanism according to claim 15, wherein the ceiling frame facing one end of the operating plate extends horizontally in a direction opposite to the operating plate.

17. The headwear size adjustment mechanism according to claim 14, wherein the belt is formed of a common cloth constituting the body of the headwear.

18. The headwear size adjustment mechanism according to claim 14, wherein a mark is put on a cloth constituting the body of the headwear in a portion corresponding to the pressing part.

19. The headwear size adjustment mechanism according to claim 14, wherein an opening having a size to expose only appearance of the pressing part is provided in a cloth constituting the body of the headwear in a portion corresponding to the pressing part.

20. The headwear size adjustment mechanism according to claim 14, wherein a sheath into which the front end of the band is capable of entering is provided between the sweatband and the lower rim.

21. The headwear size adjustment mechanism according to claim 14, wherein a friction reducing sheet is provided on the sweatband and/or lower rim in a position where the front end of the band enters.

* * * * *